US010217590B2

(12) United States Patent
Broghammer

(10) Patent No.: US 10,217,590 B2
(45) Date of Patent: Feb. 26, 2019

(54) MINIATURE CIRCUIT BREAKER COLOR-CODED STATE INDICATOR

(71) Applicant: SCHNEIDER ELECTRIC USA, INC., Andover, MA (US)

(72) Inventor: William Broghammer, Anamosa, IA (US)

(73) Assignee: SCHNEIDER ELECTRIC USA, INC., Andover, MA (US)

( * ) Notice: Subject to any disclaimer, the term of this patent is extended or adjusted under 35 U.S.C. 154(b) by 15 days.

(21) Appl. No.: 15/306,128

(22) PCT Filed: May 13, 2014

(86) PCT No.: PCT/US2014/037807
§ 371 (c)(1),
(2) Date: Oct. 24, 2016

(87) PCT Pub. No.: WO2015/174962
PCT Pub. Date: Nov. 19, 2015

(65) Prior Publication Data

US 2017/0053765 A1 Feb. 23, 2017

(51) Int. Cl.
*H01H 71/04* (2006.01)
*H01H 21/04* (2006.01)
*H01H 21/22* (2006.01)

(52) U.S. Cl.
CPC ..... *H01H 71/04* (2013.01); *H01H 21/04* (2013.01); *H01H 21/22* (2013.01); *H01H 2071/046* (2013.01)

(58) Field of Classification Search
CPC ..... H01H 2071/042; H01H 2069/016; H01H 2223/00; H01H 71/04; H01H 9/16; H01H 21/22; H01H 21/04; H01H 2071/046
USPC ..... 200/400, 309, 330, 331, 43.11, 43.14, 200/43.15, 43.22, 0.11, 50.21, 308, 401; 335/172, 202
See application file for complete search history.

(56) References Cited

U.S. PATENT DOCUMENTS

| | | | |
|---|---|---|---|
| 4,796,154 | A | 1/1989 | Morris et al. |
| 4,969,063 | A | 11/1990 | Scott et al. |
| 5,140,115 | A | 8/1992 | Morris |
| 5,184,717 | A | 2/1993 | Chou et al. |

(Continued)

OTHER PUBLICATIONS

International Search Report and Written Opinion dated Sep. 9, 2014 in PCT/US2014/037807, 11pp.

*Primary Examiner* — Ahmed Saeed
(74) *Attorney, Agent, or Firm* — Locke Lord LLP

(57) ABSTRACT

The invention disclosed is a circuit breaker 2, comprising a case 3 that houses circuit breaker components 16, 20, 22. The case has a handle opening 7 for an operating handle 4 to project through the handle opening. The handle opening has a viewing cut-out 6 formed on a side of the handle opening. An operating handle 4 is pivotally 10 mounted inside the case, with an outer portion 17 extending through the handle opening in the case. The operating handle is operatively coupled to a contact operating mechanism 20 and a current-responsive tripping mechanism 22 in the case. An indicator 8 is positioned on a side 9 of the operating handle. The indicator is visible through the viewing cut-out when the operating handle has been moved to a central position (FIG. 3C) in the handle opening, in response to a trip event in the circuit breaker.

11 Claims, 10 Drawing Sheets

(56) References Cited

U.S. PATENT DOCUMENTS

| | | | | |
|---|---|---|---|---|
| 5,245,302 | A | 9/1993 | Brune et al. | |
| 5,831,500 | A | 11/1998 | Turner et al. | |
| 6,107,902 | A | 8/2000 | Zhang et al. | |
| 6,225,881 | B1 * | 5/2001 | Felden | H01H 71/04 335/167 |
| 6,259,340 | B1 | 7/2001 | Fuhr et al. | |
| 6,542,056 | B2 | 4/2003 | Nerstrom et al. | |
| 6,803,535 | B1 | 10/2004 | Whipple et al. | |
| 7,135,945 | B2 | 11/2006 | Whipple et al. | |
| 7,358,838 | B2 | 4/2008 | Gibson et al. | |
| 7,569,785 | B2 | 8/2009 | Mills et al. | |
| 8,134,092 | B2 | 3/2012 | Turner et al. | |

* cited by examiner

MINIATURE CIRCUIT BREAKER COLOR-CODED STATE INDICATOR

FIELD OF THE INVENTION

The invention disclosed relates to circuit breakers.

BACKGROUND

Miniature circuit breakers have been provided with a trip flag movable to a position wherein it is visible through a window in a cover of the circuit breaker to indicate that the circuit breaker is tripped and the contacts have been opened. The trip flag typically attaches to a trip lever of a current-responsive tripping mechanism, to indicate the breaker state. The trip flag must be covered with a clear viewing window in the case of the circuit breaker, to protect the user from electrically live components. The user may not notice that the operating handle remains in the ON position and may inadvertently begin working on the live circuit, if no check is made for a zero potential before starting work.

SUMMARY

By contrast, the invention provides a simple, safe, practical and easily manufactured indictor of a state in a miniature circuit breaker, which reduces the number of parts previously required for state indicators. The circuit breaker case has a handle opening for an operating handle to project through it. The handle opening has a viewing cut-out formed on a side of the handle opening, adjacent to the operating handle. An indicator is positioned on the side of the operating handle and is insulated from the electrical current path. The viewing cut-out adjacent to the operating handle, allows the indicator to be viewed when the operating handle has been moved to a "tripped" position in the handle opening, when the current-responsive tripping mechanism has detected an over-current. The indicator moves with the operating handle and indicates that the breaker is in the tripped state. The indicator may be on either or both sides of the handle.

In this manner, the operator will see that the breaker is not tripped, but remains ON when the contacts are welded, and will avoid working on the circuit until the operator moves the operating handle, thus breaking the contact weld when moving the handle to the OFF position.

Additional indicators that indicate the OFF-state and the ON-state, may be positioned on either side of the indicator of the tripped state. Alternately, the shoulders of the operating handle may be distinctly colored so as to be viewable through the handle opening, thereby indicating the ON, OFF and TRIPPED states of the circuit breaker.

DESCRIPTION OF EMBODIMENTS OF THE INVENTION

Figure 1:
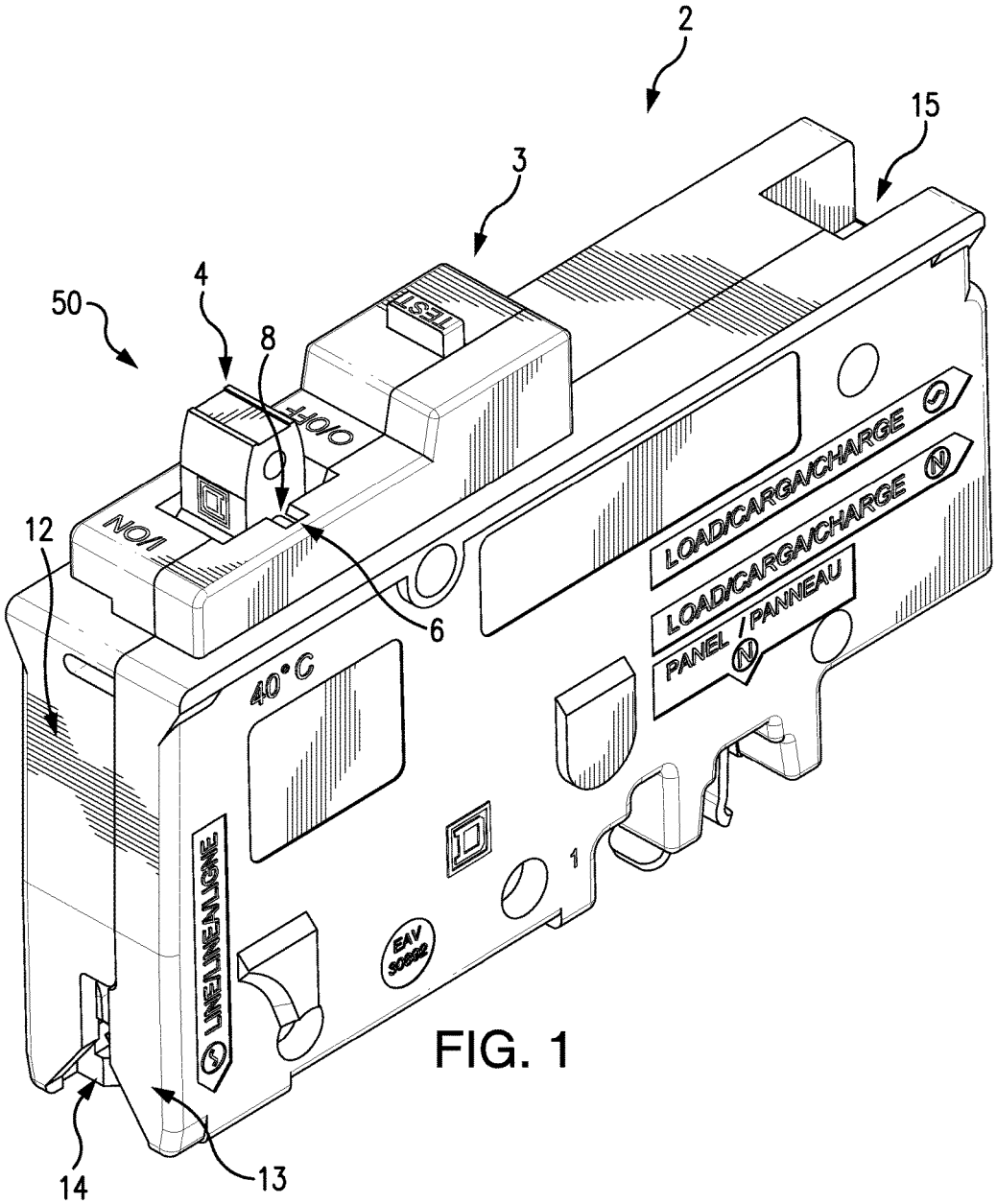
FIG. 1 is a front perspective view from the top right side of an example embodiment of the invention in a miniature circuit breaker. The figure illustrates a circuit breaker case with an operating handle projecting through a handle opening that has a viewing cut-out formed on a side of the handle opening, adjacent to the operating handle. An indicator is shown positioned on the side of the operating handle and aligned with the viewing cut-out when the operating handle has been moved to a central position in the handle opening, indicating a tripped state for the circuit breaker.

FIG. 1 is a front perspective view from the top right side of an example embodiment of the invention in a miniature circuit breaker 2. The circuit breaker 2 comprises a base 12 and cover 13, a line terminal 14 and a load terminal 15. A contact operating mechanism 20 (shown in FIG. 3A) is actuated by an operating handle 4 projecting through a handle opening 7 (shown in FIG. 4A) to actuate contacts 16 (shown in FIG. 3A) between a contact OPEN position and a contact CLOSED position to open or close the electrical circuit between the line terminal 14 and the load terminal 15. The operating handle 4 may be moved by a user to an OFF position toward a first end of the handle opening 7 (shown in FIG. 4A), to open the contacts 16. The operating handle 4 may be moved by the user, to an ON position toward a second end of the handle opening 7 (shown in FIG. 4B), to close the contacts 16. A current-responsive trip mechanism 22 (shown in FIG. 3A) releases the contact operating mechanism 20 to open the contacts 16 in response to a sustained moderate overload or an instantaneous short circuit. The current-responsive tripping mechanism 22 opens the contacts 16 and moves the operating handle 4 to the central position in the handle opening 7 (shown in FIG. 4C), in response to the current-responsive tripping mechanism 22 having detected an over-current in the circuit breaker. A more detailed explanation of the operation of the contact operating mechanism 20 and the current-responsive trip mechanism 22 in a miniature circuit breaker 2, is provided in U.S. Pat. No. 5,245,302 that is assigned to the same assignee as the present application, and the disclosure in which is incorporated herein by reference.

FIG. 1 shows a circuit breaker case 3 comprised of the base 12 and the cover 13. The case 3 houses circuit breaker components, such as the contacts 16, the contact operating mechanism 20 and the current-responsive trip mechanism 22. The operating handle 4 projects through the handle opening 7. The handle opening 7 has a viewing cut-out 6 formed on a side of the handle opening 7, adjacent to the operating handle 4. An indicator 8 is shown positioned on the side 9 of the operating handle (shown in FIG. 2). The indicator 8 is aligned with the viewing cut-out 6 when the operating handle 4 has been moved to the central position in the handle opening 7, indicating a tripped state 50 for the circuit breaker 2.

Figure 2:
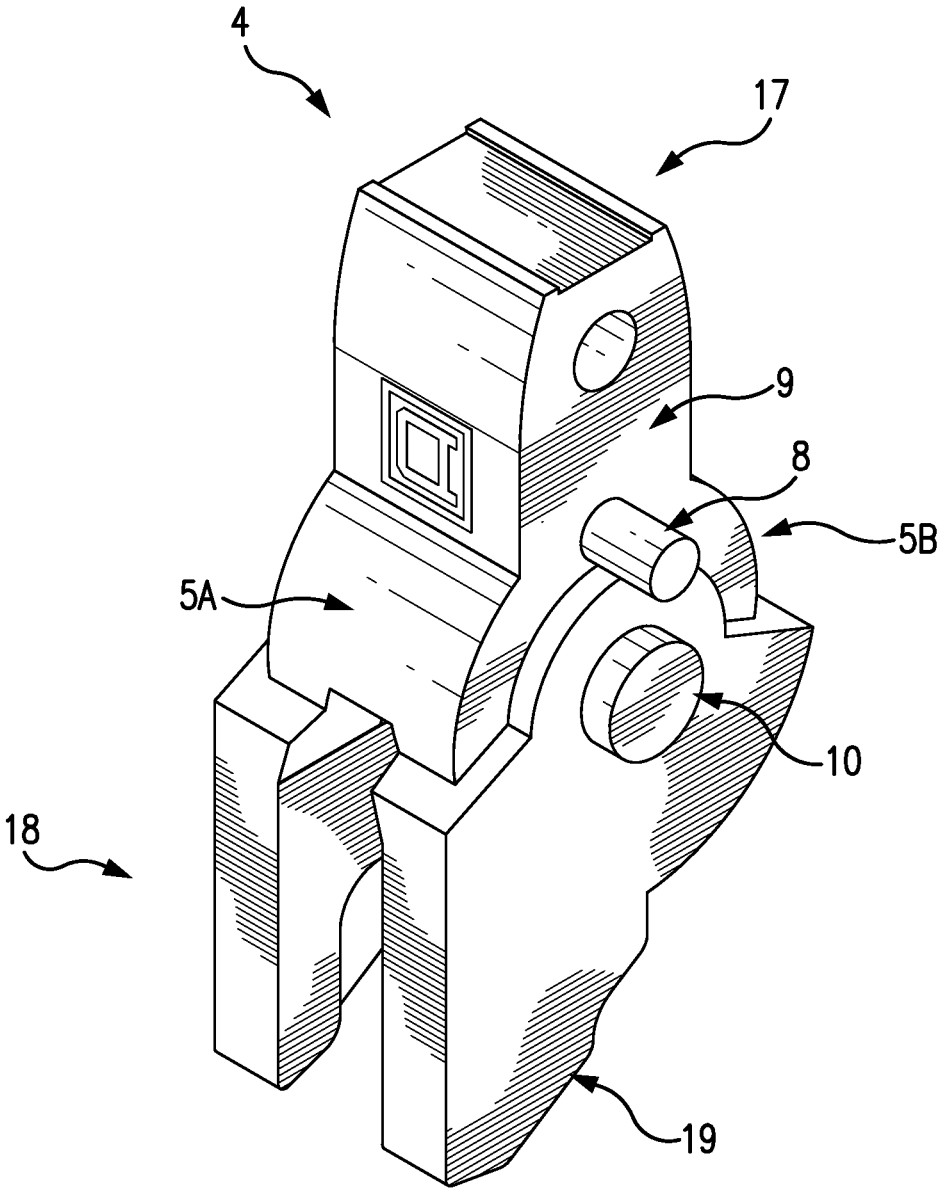
FIG. 2 is a perspective view from the top right side of an example operating handle shown in FIG. 1. The figure illustrates an example of the indicator positioned on the side of the operating handle.

FIG. 2 is a perspective view from the top right side of the example operating handle 4 shown in FIG. 1. The operating handle 4 has a body portion 18 that is pivotally mounted on the pivot 10 to the inside of the case 3. The operating handle 4 has an outer portion 17 that extends through the handle opening 7 in the case 3, with the side 9 being located adjacent to the viewing cut-out 6 (shown in FIG. 3A). The operating handle 4 includes a cam 19 that operatively couples to the contact operating mechanism 20, to open and close the contacts 16 when the user moves the operating handle 4. The cam 19 of the operating handle 4 is also operatively coupled to the current-responsive tripping mechanism 22 that moves the operating handle 4 to the central position in the handle opening 7 (shown in FIG. 4C), in response to the current-responsive tripping mechanism 22 having detected an over-current in the circuit breaker.

FIG. 2 shows the indicator 8 positioned on the side 9 of the operating handle 4. In an example embodiment, the indicator 8 may be a dowel inserted into a hole in the side 9 of the operating handle 4. In another example embodiment, the indicator 8 may be a boss projecting from the side 9 of the operating handle 4, the boss being integrally molded with the operating handle 4. In another embodiment, the indicator may be located on either or both sides of the handle.

Figure 6A:
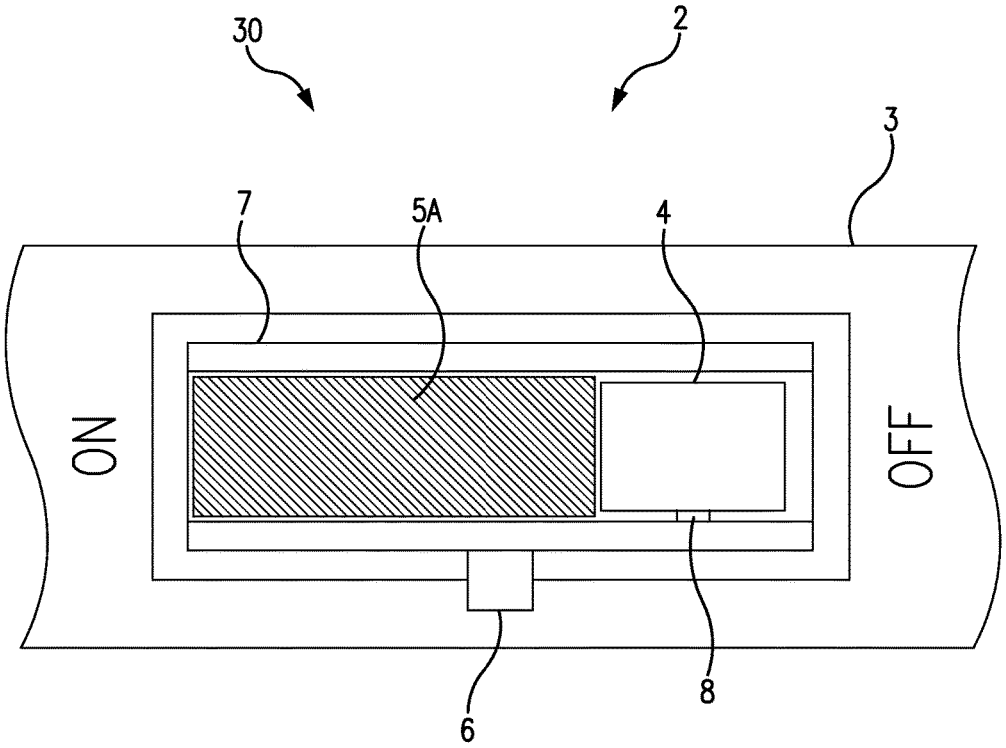
FIG. 6A is a top view of the circuit breaker of FIG. 3A, showing a detail of the first shoulder 5A of the operating handle 4, which is visible through the handle opening 7, which may have a first distinctive color, for example green, on its surface to indicate an OFF state of the circuit breaker.
Figure 6B:
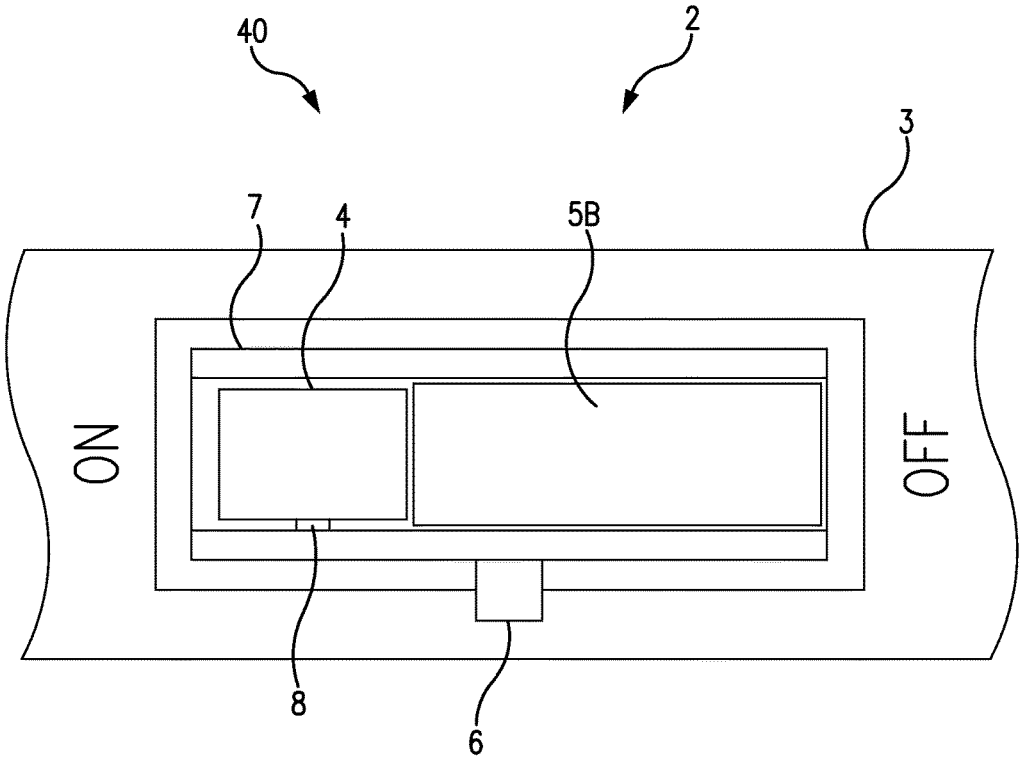
FIG. 6B is a top view of the circuit breaker of FIG. 3B, showing a detail of the second shoulder 5B of the operating handle 4, which is visible through the handle opening 7, which may have a second distinctive color, for example white, on its surface to indicate an ON state of the circuit breaker.
Figure 6C:
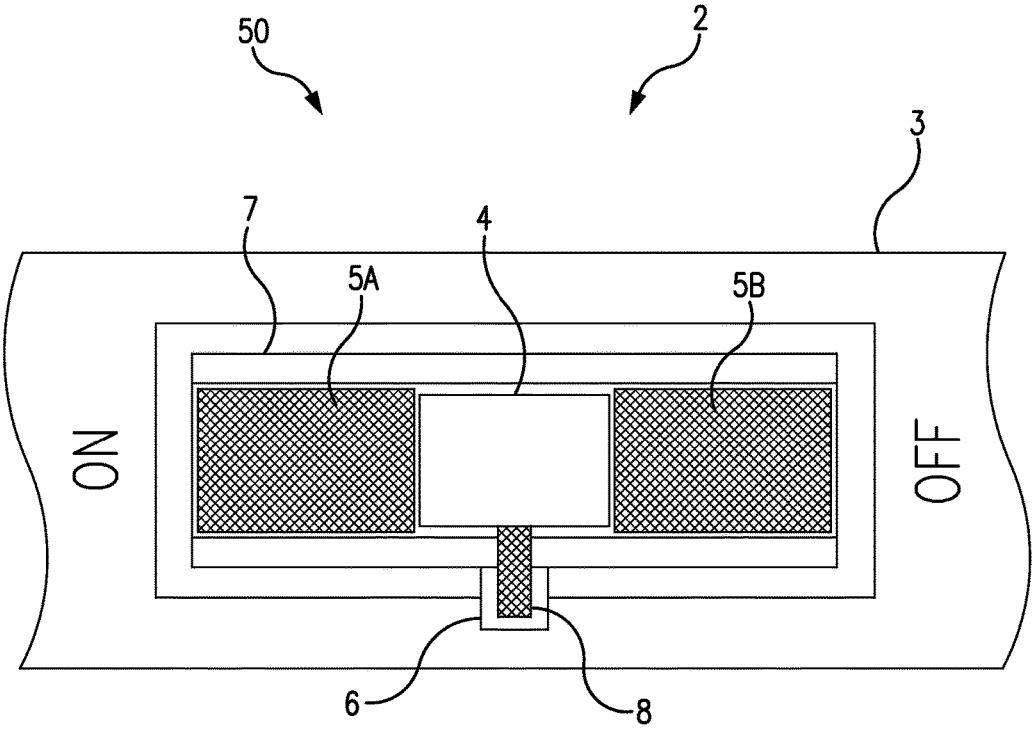
FIG. 6C is a top view of the circuit breaker of FIG. 3C, showing a detail of the first shoulder 5A and second shoulder 5B of the operating handle 4, which are visible through the handle opening 7, which may have a third distinctive color, for example orange, on its surface to indicate the tripped state of the circuit breaker.

In some embodiments of the invention, a first shoulder 5A of the operating handle 4, which is visible through the handle opening 7, may have a first distinctive color, for example green, on its surface to indicate an OFF state of the circuit breaker, as shown in FIG. 6A. In some embodiments of the invention, a second shoulder 5B of the operating handle 4 that is visible through the handle opening 7, may have a second distinctive color, for example white, on its surface to indicate an ON state of the circuit breaker, as shown in FIG. 6B. The distinctive colors may be printed or painted, for example, on the surfaces or specifically colored molding material may be used for the body of the handle. In some embodiments of the invention, a printed surface or specifically colored molding material having a third distinctive color, may be used on both the first and second shoulders of the operating handle, the printed surface being visible through the handle opening when the operating handle has been moved to a central, tripped position in the handle opening, thereby indicating a tripped state of the circuit breaker, as shown in FIG. 6C.

Figure 3A:
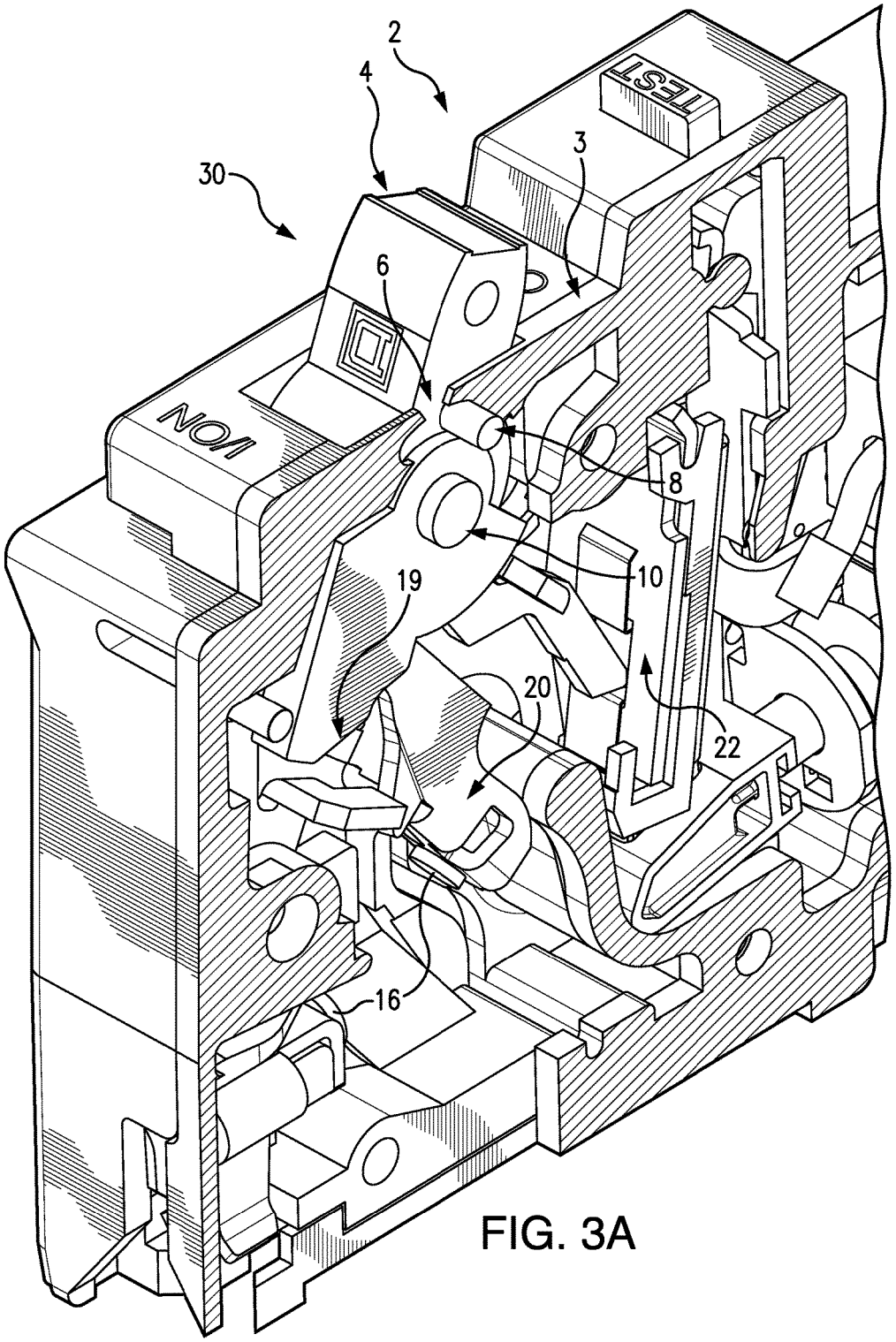
FIG. 3A is a front perspective view from the top right side of the circuit breaker of FIG. 1, with the cover removed. The operating handle is shown in an OFF position toward a first end of the handle opening and the indicator is shown to be not aligned with the viewing cut-out. In some embodiments of the invention, a first shoulder of the operating handle that is visible through the handle opening, will have a first distinctive color on its surface to indicate an OFF state of the circuit breaker.

FIG. 3A is a front perspective view from the top right side of the circuit breaker 2 of FIG. 1, with the cover 13 removed. The circuit breaker 2 is in the OFF state 30. The operating handle 4 is shown in an OFF position toward the first end of the handle opening 7 (shown in FIG. 4A) and the indicator 8 is shown to be not aligned with the viewing cut-out 6. In some embodiments of the invention, the first shoulder 5A of the operating handle 4, which is visible through the handle opening 7, may have a first distinctive color on its surface to indicate an OFF state of the circuit breaker. The figure shows the operating handle 4 being operatively coupled to the contact operating mechanism 20 in the case 3, to open the contacts 16 when the user moves the operating handle 4 toward a first end of the handle opening 7 and to close the contacts 16 when the user moves the operating handle 4 toward a second end of the handle opening 7. The figure shows the operating handle 4 being operatively coupled to the current-responsive tripping mechanism 22 in the case 3, to open the contacts 16 and to move the operating handle 4 to the central position in the handle opening 7 in response to the current-responsive tripping mechanism 22 having detected an over-current in the circuit breaker.

Figure 3B:
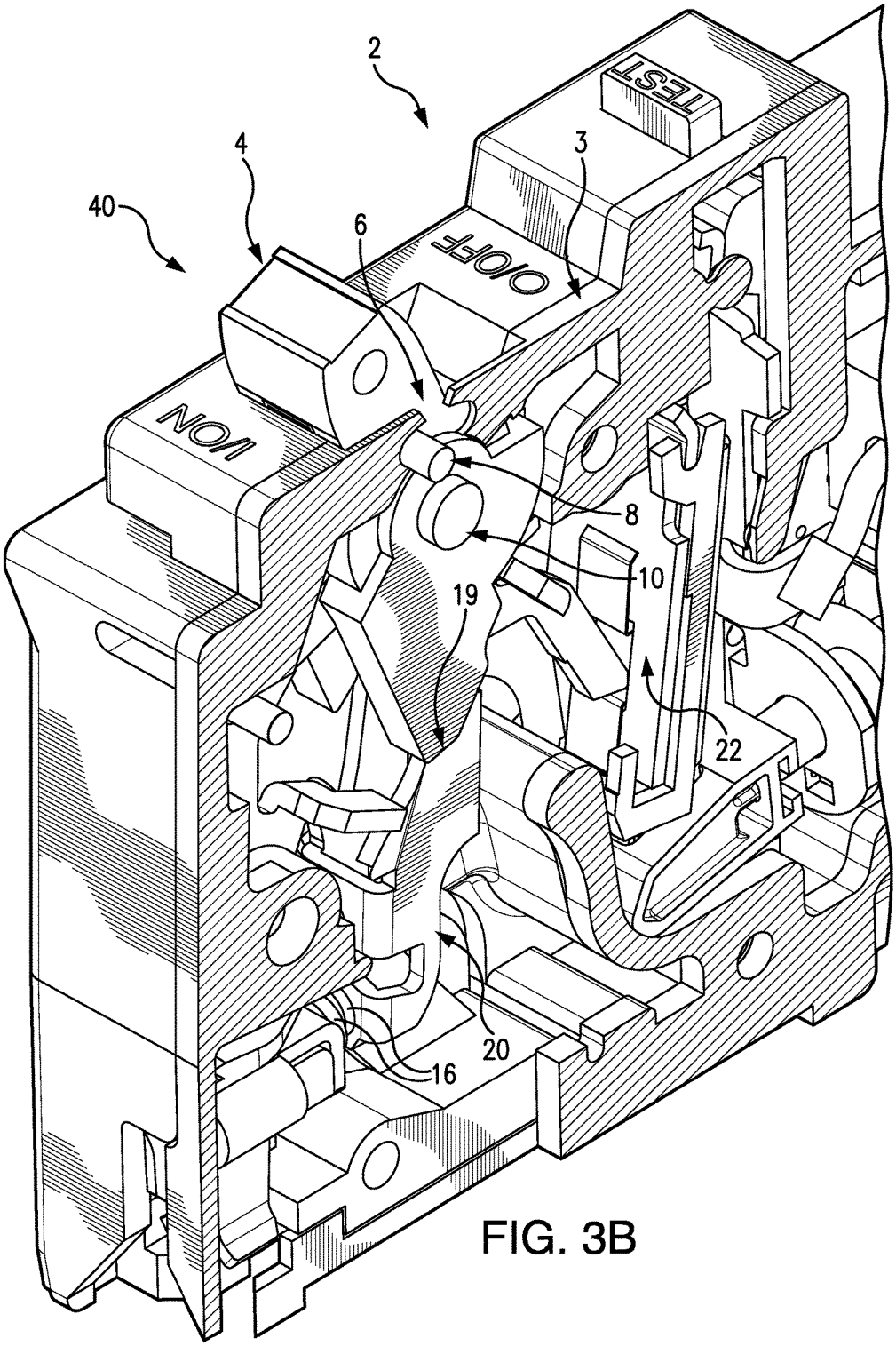
FIG. 3B is a front perspective view from the top right side of the circuit breaker of FIG. 1, with the cover removed. The operating handle is shown in an ON position toward a second end of the handle opening and the indicator is shown to be not aligned with the viewing cut-out. In some embodiments of the invention, a second shoulder of the operating handle that is visible through the handle opening, will have a second distinctive color on its surface to indicate an ON state of the circuit breaker.

FIG. 3B is a front perspective view from the top right side of the circuit breaker 2 of FIG. 1, with the cover 13 removed. The circuit breaker 2 is in the ON state 40. The operating handle 4 is shown in an ON position toward a second end of the handle opening 7 (shown in FIG. 4B) and the indicator 8 is shown to be not aligned with the viewing cut-out 6. In some embodiments of the invention, the second shoulder 5B of the operating handle 4 that is visible through the handle opening 7, may have a second distinctive color on its surface to indicate an ON state 40 of the circuit breaker.

Figure 3C:
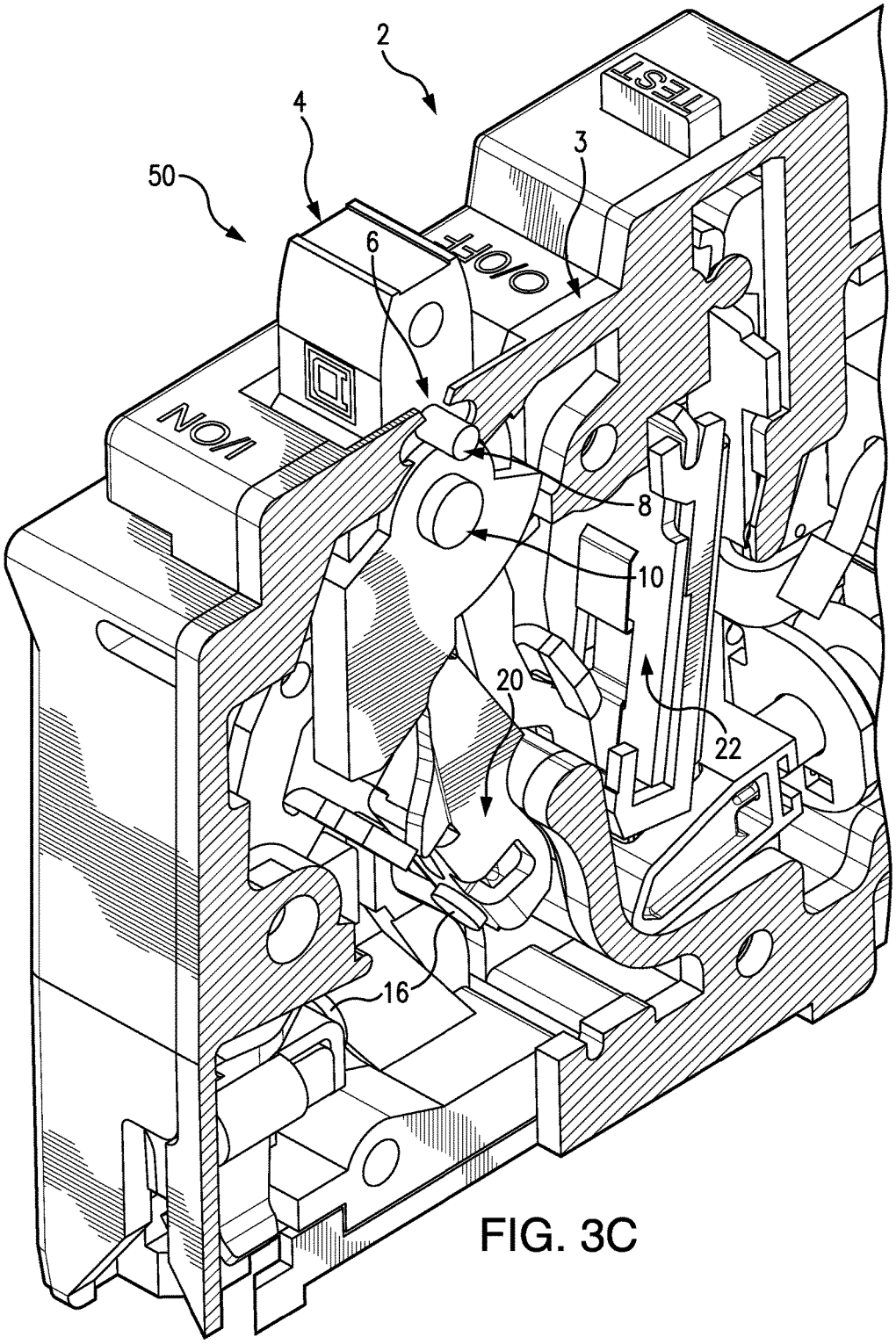
FIG. 3C is a front perspective view from the top right side of the circuit breaker of FIG. 1, with the cover removed. The operating handle is shown to have been moved to a central position in the handle opening and the indicator is shown to be aligned with the viewing cut-out with a third distinctive color on its surface to indicate a tripped state of the circuit breaker.

FIG. 3C is a front perspective view from the top right side of the circuit breaker 2 of FIG. 1, with the cover 13 removed. The circuit breaker 2 is in the tripped state 50. The operating handle 4 is shown to have been moved to the central position in the handle opening 7 (shown in FIG. 4C) and the indicator 8 is shown to be aligned with the viewing cut-out 6, the indicator 8 being visible through the viewing cut-out 6 to indicate the tripped state 50 of the circuit breaker.

Figure 4A:
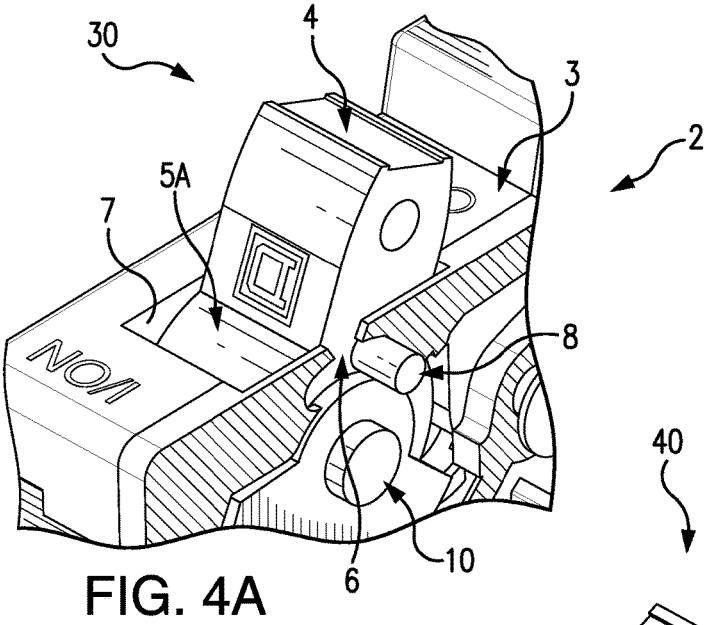
FIG. 4A is a front perspective view from the top right side of the circuit breaker of FIG. 3A, showing a detail of the indicator and viewing cut-out. The operating handle is shown in the OFF position and the indicator is shown to be not aligned with the viewing cut-out. The first shoulder of the operating handle that is visible through the handle opening, may have a first distinctive color on its surface to indicate the OFF state of the circuit breaker.

FIG. 4A is a front perspective view from the top right side of the circuit breaker 2 of FIG. 3A, showing a detail of the indicator 8 and viewing cut-out 6. The operating handle 4 is shown in the OFF position and the indicator 8 is shown to be not aligned with the viewing cut-out. The first shoulder 5A of the operating handle that is visible through the handle opening 7, may have a first distinctive color on its surface to indicate the OFF state 30 of the circuit breaker, as shown in FIG. 6A.

Figure 4B:
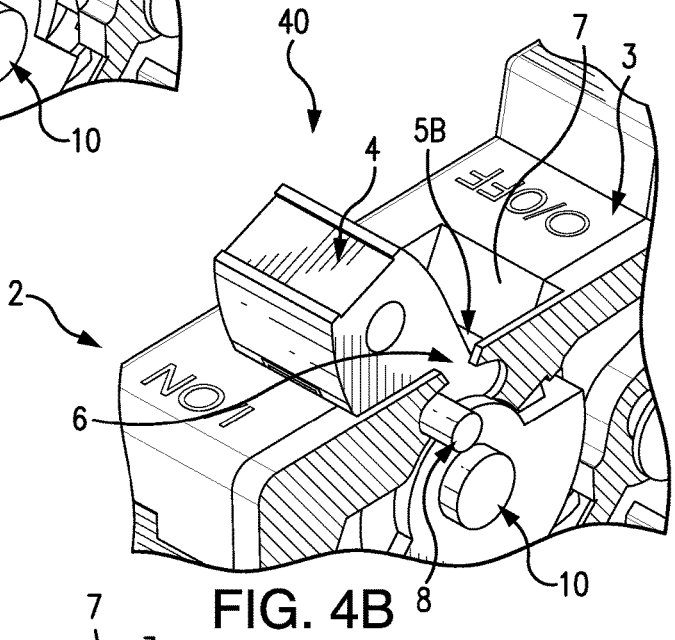
FIG. 4B is a front perspective view from the top right side of the circuit breaker of FIG. 3B, showing a detail of the indicator and viewing cut-out. The operating handle is shown in the ON position and the indicator is shown to be not aligned with the viewing cut-out. The second shoulder of the operating handle that is visible through the handle opening, may have a second distinctive color on its surface to indicate the ON state of the circuit breaker.

FIG. 4B is a front perspective view from the top right side of the circuit breaker 2 of FIG. 3B, showing a detail of the indicator 8 and viewing cut-out 6. The operating handle 4 is shown in the ON position and the indicator 8 is shown to be not aligned with the viewing cut-out 6. The second shoulder 5B of the operating handle 4 that is visible through the handle opening 7, may have a second distinctive color on its surface to indicate the ON state 40 of the circuit breaker, as shown in FIG. 6B.

Figure 4C:
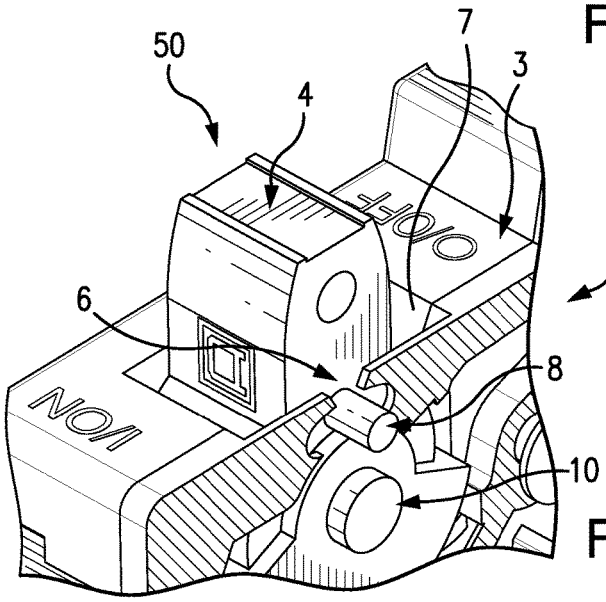
FIG. 4C is a front perspective view from the top right side of the circuit breaker of FIG. 3C, showing a detail of the indicator and viewing cut-out. The operating handle is shown to have been moved to the central position in the handle opening and the indicator is shown to be aligned with the viewing cut-out with a third distinctive color on its surface to indicate a tripped state of the circuit breaker.

FIG. 4C is a front perspective view from the top right side of the circuit breaker 2 of FIG. 3C, showing a detail of the indicator 8 and viewing cut-out 6. The operating handle 4 is shown to have been moved to the central position in the handle opening 7 and the indicator 8 is shown to be aligned with the viewing cut-out 6, the indicator 8 being visible through the viewing cut-out 6 to indicate a tripped state of the circuit breaker. A third distinctive color may be used on the surface of both the first shoulder 5A and second shoulder 5B of the operating handle 4, the colored surface being visible through the handle opening 7 when the operating handle has been moved to a central, tripped position in the handle opening, thereby indicating a tripped state 50 of the circuit breaker, as shown in FIG. 6C.

Figure 5:
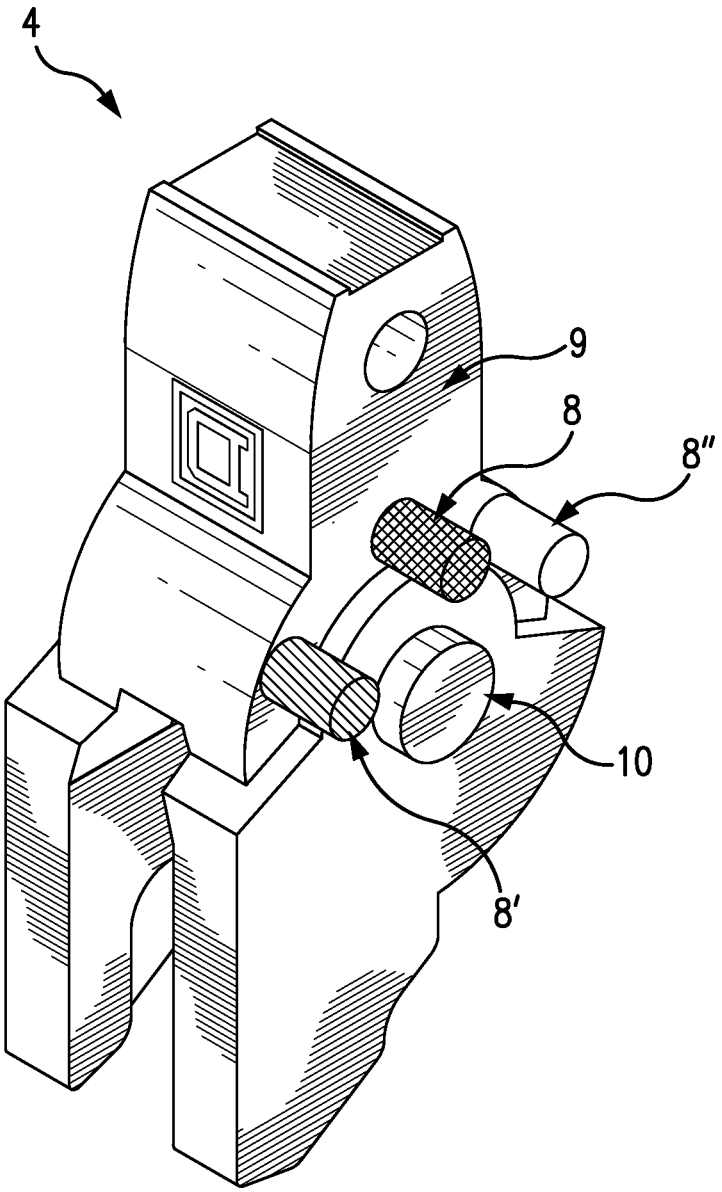
FIG. 5 is a perspective view from the top right side of an alternate example operating handle that is a variation of that shown in FIGS. 1 and 2. The figure illustrates an example of the first indicator positioned on the side of the operating handle to indicate a tripped state of the circuit breaker when it is aligned with the viewing cut-out. The figure shows a second indicator positioned on the side of the operating handle, the second indicator being visible through the viewing cut-out when the operating handle has been moved to an OFF position in the handle opening, to indicate an OFF state of the circuit breaker. The figure shows a third indicator positioned on the side of the operating handle, the third indicator being visible through the viewing cut-out when the operating handle has been moved to an ON position in the handle opening, to indicate an ON state of the circuit breaker.

FIG. 5 is a perspective view from the top right side of an alternate example operating handle 4 that is a variation of that shown in FIGS. 1 and 2. The figure illustrates an example of the first indicator 8 positioned on the side 9 of the operating handle 4 to indicate the tripped state 50 of the circuit breaker 2 when the indicator 8 is aligned with the viewing cut-out 6 (FIG. 4C). The first indicator 8 may have a distinctive color, for example orange. The figure shows a second indicator 8' positioned on the side 9 of the operating handle 4, the second indicator 8' being visible through the viewing cut-out 6 when the operating handle has been moved to an OFF position (FIG. 4A) in the handle opening 7, to indicate an OFF state 30 of the circuit breaker. The second indicator 8' may have a distinctive color, for example green. The figure shows a third indicator 8" positioned on the side 9 of the operating handle 4, the third indicator 8" being visible through the viewing cut-out 6 when the operating handle 4 has been moved to an ON position (FIG. 4B) in the handle opening 7, to indicate an ON state 40 of the circuit breaker. The third indicator 8" may have a distinctive color, for example white. In an example embodiment, the indicators 8, 8', and 8" may be dowels or other shaped bodies inserted into holes in the side 9 of the operating handle 4. In another example embodiment, the indicators 8, 8', and 8" may each be a boss projecting from the side 9 of the operating handle 4, the boss being integrally molded with the operating handle 4.

FIG. 6A is a top view of the circuit breaker of FIG. 3A, showing a detail of the first shoulder 5A of the operating handle 4, which is visible through the handle opening 7, which may have a first distinctive color, for example green, on its surface to indicate an OFF state of the circuit breaker.

FIG. 6B is a top view of the circuit breaker of FIG. 3B, showing a detail of the second shoulder 5B of the operating handle 4, which is visible through the handle opening 7, which may have a second distinctive color, for example white, on its surface to indicate an ON state of the circuit breaker.

FIG. 6C is a top view of the circuit breaker of FIG. 3C, showing a detail of the first shoulder 5A and second shoulder 5B of the operating handle 4, which are visible through the handle opening 7, which may have a third distinctive color, for example orange, on its surface to indicate the tripped state of the circuit breaker.

Although specific example embodiments of the invention have been disclosed, persons of skill in the art will appreciate that changes may be made to the details described for the specific example embodiments, without departing from the spirit and the scope of the invention.

The invention claimed is:

1. A circuit breaker, comprising:

a case having a handle opening for an operating handle to project through the handle opening, the handle opening having a viewing cut-out formed on a side of the handle opening;

an operating handle pivotally mounted inside the case, with an outer portion of the operating handle extending through the handle opening in the case, a side surface of the operating handle being located adjacent to the viewing cut-out; and an indicator positioned on the side surface of the operating handle, the indicator being visible through the viewing cut-out when the operating handle has been moved to a central position in the handle opening, thereby indicating a tripped state of the circuit breaker.

2. The circuit breaker of claim 1, further comprising:

a second indicator positioned on the side surface of the operating handle, the second indicator being visible through the viewing cut-out when the operating handle has been moved to an OFF position in the handle opening, to indicate an OFF state of the circuit breaker; and a third indicator positioned on the side surface of the operating handle, the third indicator being visible through the viewing cut-out when the operating handle has been moved to an ON position in the handle opening, to indicate an ON state of the circuit breaker.

3. The circuit breaker of claim 1, further comprising:

a first surface having a first distinctive color on a first shoulder of the operating handle, the first surface being visible through the handle opening when the operating handle has been moved to an OFF position in the handle opening, to indicate an OFF state of the circuit breaker; and a second surface having a second distinctive color on a second shoulder of the operating handle, the second surface being visible through the handle opening when the operating handle has been moved to an ON position in the handle opening, to indicate an ON state of the circuit breaker.

4. The circuit breaker of claim 1, further comprising:

the operating handle being operatively coupled to a contact operating mechanism in the case, to open contacts when a user moves the operating handle toward a first end of the handle opening and to close the contacts when the user moves the operating handle toward a second end of the handle opening.

5. The circuit breaker of claim 1, further comprising:

the operating handle being operatively coupled to a current-responsive tripping mechanism inside the case.

6. The circuit breaker of claim 1, wherein the indicator is a dowel or other shape on the side surface of the operating handle.

7. The circuit breaker of claim 1, wherein the indicator is a boss projecting from the side of the operating handle, the boss being integrally molded with the operating handle.

8. A circuit breaker, comprising:

a case housing circuit breaker components, the case having a handle opening for an operating handle to project through the handle opening, the handle opening having a viewing cut-out formed on a side of the handle opening;

an operating handle pivotally mounted inside the case, with an outer portion of the operating handle extending through the handle opening in the case, a side surface of the operating handle being located adjacent to the viewing cut-out, the operating handle being operatively coupled to a contact operating mechanism in the case, to open contacts when a user moves the operating handle toward a first end of the handle opening and to close the contacts when the user moves the operating handle toward a second end of the handle opening, the operating handle being operatively coupled to a current-responsive tripping mechanism in the case, to open the contacts and to move the operating handle to a central position in the handle opening in response to the current-responsive tripping mechanism having detected an over-current in the circuit breaker; and an indicator positioned on the side surface of the operating handle, the indicator being visible through the viewing cut-out when the operating handle has been moved to the central position in the handle opening, thereby indicating a tripped state of the circuit breaker.

9. The circuit breaker of claim 8, further comprising:

a second indicator positioned on the side surface of the operating handle, the second indicator being visible through the viewing cut-out when the operating handle has been moved to an OFF position in the handle opening, thereby indicating an OFF state of the circuit breaker; and a third indicator positioned on the side surface of the operating handle, the third indicator being visible through the viewing cut-out when the operating handle has been moved to an ON position in the handle opening, thereby indicating an ON state of the circuit breaker.

10. The circuit breaker of claim 8, further comprising:

a first printed surface or specifically colored molding material having a first distinctive color on a first shoulder of the operating handle, the first printed surface being visible through the handle opening when the operating handle has been moved to an OFF position in the handle opening, thereby indicating an OFF state of the circuit breaker; and a second printed surface or specifically colored molding material having a second distinctive color on a second shoulder of the operating handle, the second printed surface being visible through the handle opening when the operating handle has been moved to an ON position in the handle opening, thereby indicating an ON state of the circuit breaker.

11. The circuit breaker of claim 8, further comprising:

a printed surface or specifically colored molding material having a distinctive color on both first and second shoulders of the operating handle, the printed surface being visible through the handle opening when the operating handle has been moved to a central, tripped position in the handle opening, thereby indicating a tripped state of the circuit breaker.

* * * * *